US006783406B2

(12) United States Patent
Keiser et al.

(10) Patent No.: US 6,783,406 B2
(45) Date of Patent: Aug. 31, 2004

(54) ELASTIC, ELECTRICALLY CONDUCTIVE CONTACT SPRINGS

(75) Inventors: Markus Keiser, Reitnau (CH); Peter Wagner, Oetwil (CH)

(73) Assignee: Alstom, Paris (FR)

( * ) Notice: Subject to any disclaimer, the term of this patent is extended or adjusted under 35 U.S.C. 154(b) by 307 days.

(21) Appl. No.: 09/880,145

(22) Filed: Jun. 14, 2001

(65) Prior Publication Data

US 2002/0004344 A1 Jan. 10, 2002

(30) Foreign Application Priority Data

Jun. 29, 2000 (FR) ..... 00 08429

(51) Int. Cl.[7] ..... H01R 13/17
(52) U.S. Cl. ..... 439/827
(58) Field of Search ..... 439/827, 816, 439/842, 843, 886, 885

(56) References Cited

U.S. PATENT DOCUMENTS

| | | | | | |
|---|---|---|---|---|---|
| 3,453,587 | A | * | 7/1969 | Neidecker | 439/843 |
| 3,861,776 | A | * | 1/1975 | Deal | 439/434 |
| 4,083,622 | A | * | 4/1978 | Neidecker | 439/86 |
| 4,128,293 | A | * | 12/1978 | Paoli | 439/843 |
| 4,191,445 | A | * | 3/1980 | Deal | 439/843 |
| 4,720,157 | A | * | 1/1988 | Nestor et al. | 439/851 |
| 5,147,229 | A | * | 9/1992 | Nestor | 439/843 |
| 5,261,840 | A | * | 11/1993 | Benz | 439/843 |
| 5,360,355 | A | | 11/1994 | Ehrler et al. | 439/816 |
| 5,681,187 | A | * | 10/1997 | Fukushima et al. | 439/700 |

FOREIGN PATENT DOCUMENTS

| | | | |
|---|---|---|---|
| DE | 26 34 374 | 5/1977 | H01R/13/12 |
| FR | 2 339 259 | 8/1977 | H01R/7/28 |

OTHER PUBLICATIONS

European Search Report dated May 2, 2001.

* cited by examiner

*Primary Examiner*—Tulsidas C. Patel
(74) *Attorney, Agent, or Firm*—Sughrue Mion, PLLC

(57) ABSTRACT

The method consists in using a strip of a plastically deformable material which is capable of acquiring elastic spring properties after treatment. The central portion of the strip is coated in a layer of electrically conductive material and then the strip is punched so as to obtain springs which are interconnected at their ends by two continuous side strips. Thereafter, the springs are displaced from the plane of the strip being twisted about their respective longitudinal axes, and one edge of each spring is folded down as a hem in the direction which ensures that the layer of conductive material remains on the outside of the fold. Thereafter, the strip is subjected to hardening treatment to confer elastic properties thereto.

4 Claims, 4 Drawing Sheets

ELASTIC, ELECTRICALLY CONDUCTIVE CONTACT SPRINGS

The present invention relates to a method of fabricating a strip of electric contact springs for an electrical connector, said springs being united at their ends by two continuous side strips, the springs being displaced from the plane of said side strips by being twisted about their respective longitudinal axes that are perpendicular to the length of the strip.

BACKGROUND OF THE INVENTION

Such a strip of electric contact springs is used in an electrical connector comprising two parts respectively connected to one or the other of members that are to be electrically interconnected, the strip being an intermediate contact member providing contact that is resilient, and being associated with one of the two parts. The connector can be plane and can have two contact plates between which the strip is placed, being associated with one of the plates, or it can be a coaxial cylindrical connector having a male portion and a female portion, one of these two portions including a housing for the strip.

The invention applies particularly, although not exclusively, to contacts for passing permanent currents in high voltage or medium voltage switchgear.

Document FR 2 339 259 describes, with reference to FIGS. 7, 10, and 11 of that document, a strip of electric contact springs of the type defined above. In that document, the strip of springs is made of a material that can be electrically conductive or non-conductive, and the central portions of the springs are coated in an electrically conducive material that envelops both of the edges of each spring. That disposition thus makes it possible to separate the two functions that are required to achieve contact that is both elastic and that provides good electrical conductivity. The material of the strip needs only be capable of ensuring that contact is elastic, as though it were a spring, and it no longer needs to have good qualities of electrical conductivity. However, the strip of springs described in the above document, in which each spring has a layer of electrically conductive material enveloping both edges of the spring, is not easy to fabricate, since each spring needs to be coated individually in its own conductive layer.

OBJECTS AND SUMMARY OF THE INVENTION

The present invention seeks to provide a method which ensures that a strip of electric contact springs is easy to fabricate.

The invention thus provides a method of fabricating a strip of electric contact springs for an electrical connector, said springs being united at their ends by two continuous side strips, the springs being displaced from the plane of said side strips by being twisted about their respective longitudinal axes that are perpendicular to the length of the strip, wherein the starting material is a strip of a plastically deformable material that is capable of acquiring elastic spring properties after treatment, at least the central portion of the strip is coated on only one of its two faces in a layer of a material that is a good conductor of electricity, said strip then being punched so as to obtain said springs and continuous side strips, and said springs are then displaced from the plane of said side strips by said twisting, and wherein one edge of each spring is folded down as a hem in the direction that ensures that the electrically conductive coating remains on the outside of the fold, and said strip is then subjected to hardening treatment to confer elastic spring properties thereto.

The invention also provides a strip of electric contact springs for an electrical connector, said springs being united at their ends by two continuous side strips, the springs being displaced from the plane of said strips by twisting about their respective longitudinal axes that are perpendicular to the length of the strip, said strip being made of a material having elastic spring properties, wherein at least the central portion of each spring is coated on one only of its faces in a material that is a good conductor of electricity, and wherein one of the edges of each spring is folded down as a hem in the direction which causes the electrically conductive coating to appear on the outside of the fold.

BRIEF DESCRIPTION OF THE DRAWINGS

An embodiment of the invention is described below with reference to the accompanying drawings, in which.

MORE DETAILED DESCRIPTION

Figure 6:
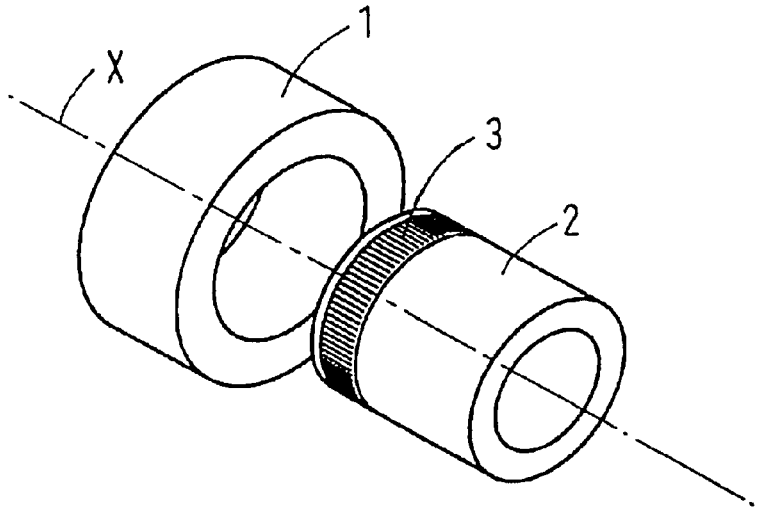
FIG. 6 is a diagram showing a cylindrical coaxial electrical connector using a strip of electric contact springs of the invention.

FIG. 6 is highly diagrammatic and shows a cylindrical coaxial electrical connector comprising a female portion 1 and a male portion 2 both made of electrically conductive materials. An intermediate strip 3 of electric contact springs is associated with the male portion 2. This intermediate strip is to provide good electrical contact between the male and female portions 2 and 1 and it also has the function of providing elastic contact between these two portions.

Such a strip 3 of electric contact springs can also be used in an electrical connector that is plane where the two portions 1 and 2 are then plane portions and the strip 3 is associated with one of them.

With reference now to FIGS. 1 to 5, the method of fabricating such a strip 3 of electric contact springs is described.

Figure 1:
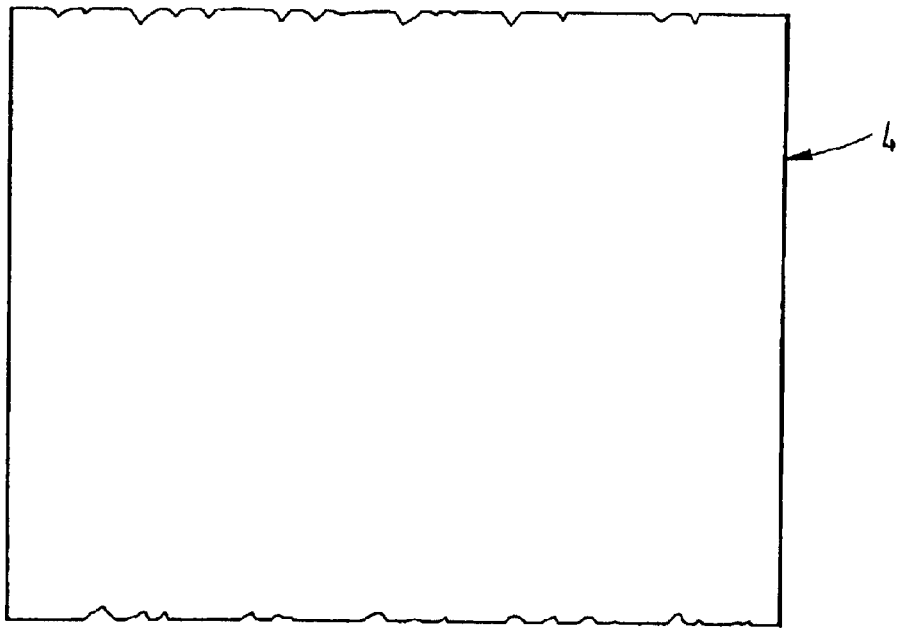
FIGS. 1 to 5 show the steps in the method of fabricating a strip of electric contact springs of the invention, with FIGS. 4 and 5 showing the final result.

In FIG. 1, the starting material is a strip 4 of plastically deformable material which is capable, after treatment, of acquiring elastic spring properties. By way of example, a beryllium bronze alloy can be used. This material can be softened by heat treatment at 750° C. followed by quenching which gives it good malleability.

Figure 2:
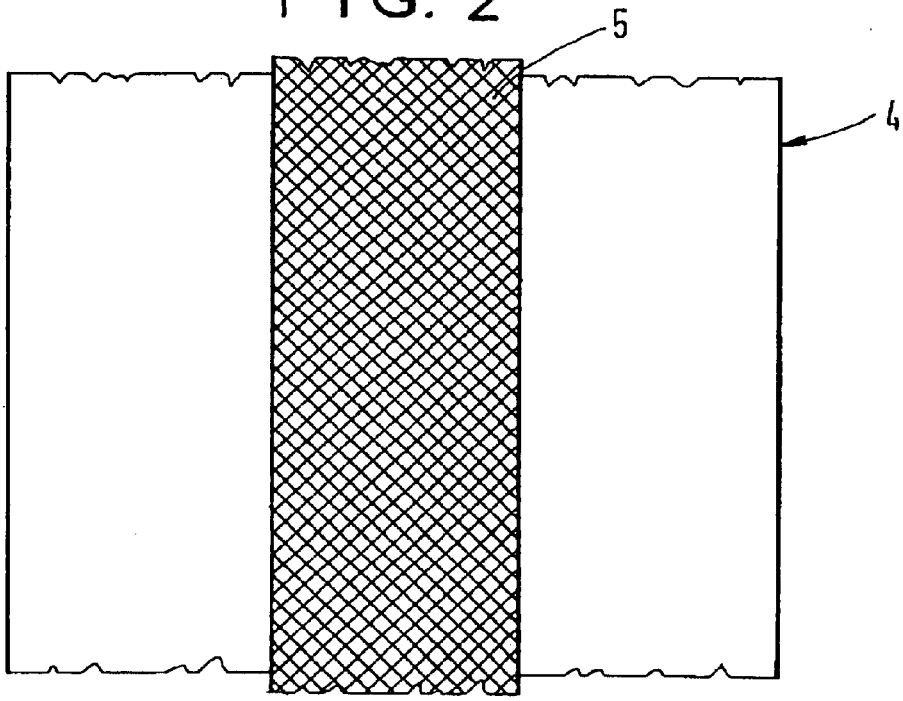
Figure 3:
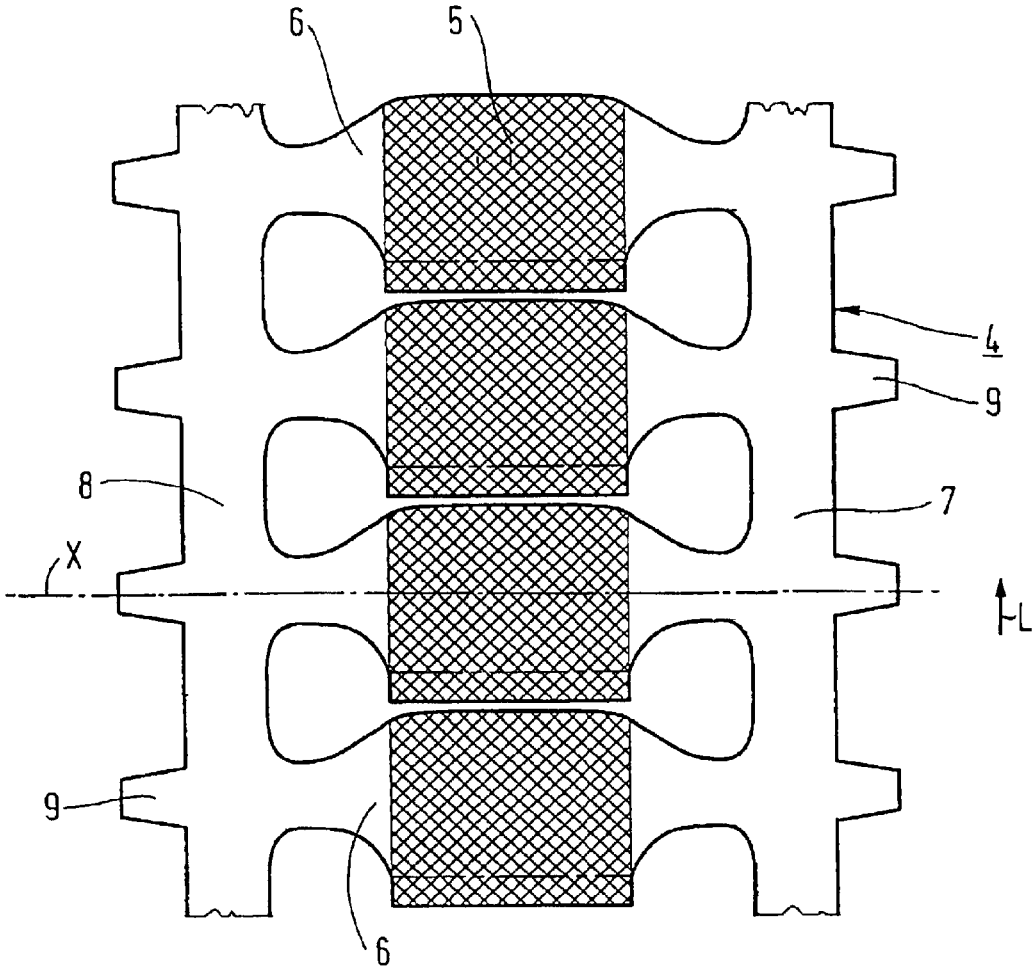

Starting with such a material, and as shown in FIG. 2, the central portion of the strip receives, on one of its faces only, a layer 5 of a material that is a good conductor of electricity. By way of example, this can be silver plating. As shown in FIG. 3, the strip 4 is then punched so as to cut it out with the desired outlines, leaving springs 6 connected at both ends to two continuous side strips 7 and 8, and also leaving side tongues 9 used for connecting the strip to that one of the two connector portions with which it is to be associated.

The springs 6 are then displaced from the plane of the side strips 7 and 8 by being twisted about their own longitudinal axes X extending perpendicular to the length L of the strip. The edges 10 and 11 of each spring, as can be seen in FIG. 5, are also curved, and above all one of the edges, the edge shown at the bottom in FIG. 5, is folded right down to form a hem 12, as can be seen clearly in FIG. 5.

Naturally, the hem 12 is folded in the appropriate direction to ensure that the electrically conductive plating 5 remains on the outside of the fold.

Figure 4:
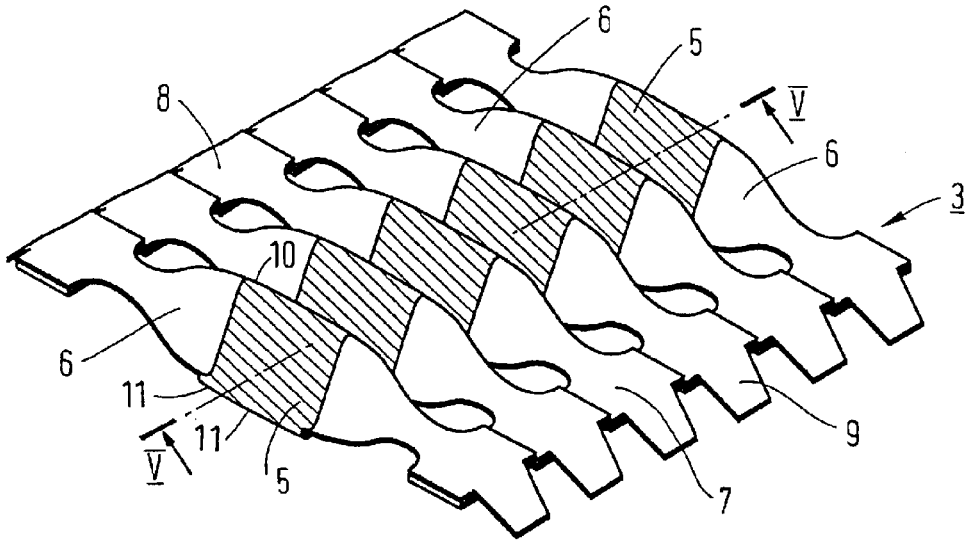
Figure 5:
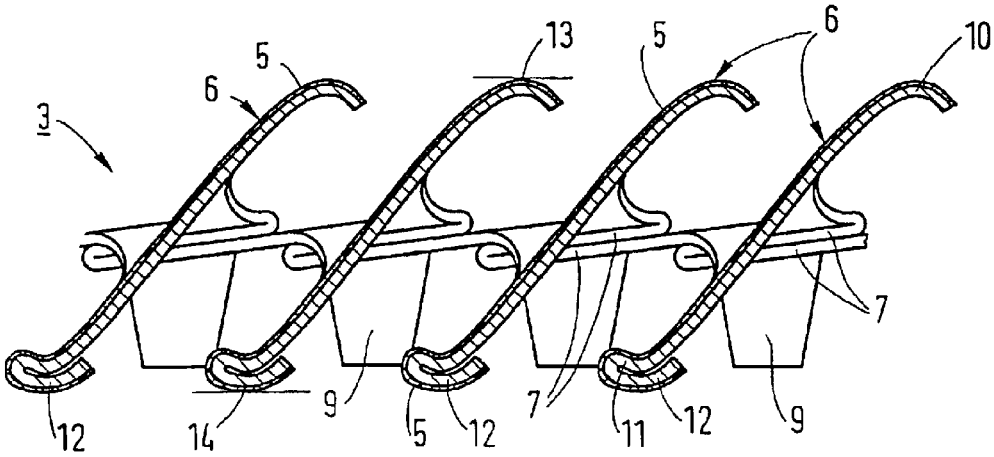

As also shown in FIGS. 4 and 5, and more particularly in FIG. 5 which shows the strip in section on V—V of FIG. 4, the side strips 7 and 8 are themselves pleated so as to move the springs 6 closer to one another, thereby increasing the number of springs per unit length of strip.

When the strip is thus placed between the two complementary portions of an electrical connector (whether plane or cylindrical as shown in FIG. 6), the points of contact between each spring for passing electricity from one part to the other are the points referenced 13 and 14 on one of the springs 6 in FIG. 5. Thus, because of the "hem" 12, there is no need to provide plating that goes round the edges of the springs 6, thereby facilitating fabrication thereof since it suffices to use any conventional means to plate only one of the two faces of the original strip 4, as shown in FIG. 2.

The punching and the shaping operations: twisting and folding, are subsequently performed very easily.

Once the strip has been shaped, it suffices to subject it to treatment for imparting elastic spring properties thereto.

In the example mentioned of a strip of beryllium bronze alloy, hardening treatment is performed which comprise heating to about 325° C. for about three hours.

The invention thus makes it very simple to fabricate a strip of electric contact springs in which it is possible to select a material for its mechanical and elastic qualities independently of its electrical conductivity qualities.

What is claimed is:

1. A strip of electric contact springs for an electrical connector, said springs being integral at their lengthwise ends with two continuous side strips, the springs being displaced from a plane of said side strips by twisting about their respective longitudinal axes, said strip being made of a material having elastic spring properties, wherein each spring includes at least two faces, and at least a central portion of one face of each spring is coated with an electrically conductive coating, and wherein an edge of each spring is folded down as a hem in the direction which causes the electrically conductive coating to appear on an outside portion of the fold, and wherein said side strips include a plurality of side tongues.

2. The strip of claim 1, wherein said side strips are pleated and the quality of being pleated brings said springs closer to one another.

3. A strip of electrical contact springs, wherein:

said springs are elastic and include at least two surfaces, wherein only one of the surfaces is coated with an electrically conductive coating; and said springs include two ends with a first end connected to a first side strip and a second end connected to a second side strip, wherein said springs each rotate on an axis, said axis drawn from where said first end connects to said first side strip to where said second end connects to said second side strip, wherein a plane created by one of said at least two surfaces of said springs is oblique to a plane created by said first and second side strips, and wherein said side strips are pleated.

4. The strip of claim 3, wherein said pleated side strips further include side tongues, said side tongues not being pleated and being of lesser thickness than said pleated side strips.

* * * * *